United States Patent [19]

Koffski

[11] 4,181,289

[45] Jan. 1, 1980

[54] WALL LIFTER

[76] Inventor: Leonard E. Koffski, R.R. #4, 7534 Trans Canada Hwy., Duncan, British Columbia, Canada, V9L 3W8

[21] Appl. No.: 923,361

[22] Filed: Jul. 10, 1978

[51] Int. Cl.[2] ..... B66F 1/00

[52] U.S. Cl. ..... 254/107

[58] Field of Search ..... 254/105-107, 254/89 R

[56] References Cited

U.S. PATENT DOCUMENTS 2,849,211 8/1958 Shoesmith ..... 254/106

FOREIGN PATENT DOCUMENTS 495603 6/1954 Italy ..... 254/107

606344 8/1948 United Kingdom ..... 254/106

*Primary Examiner*—Robert C. Watson

*Attorney, Agent, or Firm*—Knobbe, Martens, Olson, Hubbard & Bear

[57] ABSTRACT

A wall lifter able to be made to climb a column to lift a prefabricated wall into a predetermined position. The lifter comprises a first sleeve to surround the column. A saddle engages the wall. The saddle extends forwardly of the first sleeve and is pivotably mounted. A first lever is pivotably mounted on the first sleeve adjacent the saddle. There is a fulcrum point for the first lever. A second sleeve surrounds the column and is disposed above the first sleeve when the lifter is in its useful position. A second lever extends from the second sleeve to permit tilting of the second sleeve on the column. There is a link between the first and second sleeves, pivotably connected to each sleeve. The lifter is easy to use and to make and relatively cheap.

12 Claims, 4 Drawing Figures

WALL LIFTER

FIELD OF THE INVENTION

This invention relates to a wall lifter particularly useful in the lifting of prefabricated walls.

DESCRIPTION OF PRIOR ART

Devices for lifting walls, particularly prefabricated walls of wood, are known. However, they are expensive, an undesirable characteristic particularly in a tool that need not be used very frequently. The present invention therefore seeks to provide a wall lifter that is relatively cheap and easy to make and, in a typical embodiment, merely requires the use of a piece of 2" by 4" timber such as is available on any building site. This piece of timber is used as a column and the wall lifter is made to climb the column while also engaging the upper edge of the wall.

SUMMARY OF THE INVENTION

Thus, in a first aspect, the present invention is a wall lifter able to be made to climb a column to lift a prefabricated wall into a predetermined position, the lifter comprising a first sleeve to surround the column; a saddle to engage the wall, the saddle extending forwardly of the first sleeve and being pivotably mounted; a first lever pivotally mounted on the first sleeve at a first position adjacent the saddle; a fulcrum point for the first lever; a second sleeve to surround the column disposed above the first sleeve when the lifter is in its useful position; a second lever extending from the second sleeve to permit tilting of the second sleeve on the column, and a link between the first and second sleeves, pivotably connected to each sleeve.

In one embodiment the first sleeve may be formed of spaced upper and lower brackets that can surround the column. Each of the brackets is of relatively low height. A connecting member abuts the front of the column, when the sleeve is in its useful position, and is attached to the upper and lower brackets.

In a further embodiment, the first sleeve is of substantial height and has a front wall, adjacent the saddle, a back wall and side walls. The side walls provide the mounting position for the first lever.

In this latter embodiment it can be desirable to provide the lifter with engagement means to dig into the column. A first engagement means is positioned adjacent the lower end of the front wall of the first sleeve and a second engagement means is positioned adjacent an upper edge of the rear wall of the first sleeve, both positions being defined when the lifter is in its useful position. The engagement means may be, for example, blades extending downwardly, again when the lifter is in its useful position.

It is desirable that the wall lifter be associated with a non-slip shoe. This shoe locates the base of the column during the lifting of the wall.

BRIEF DESCRIPTION OF DRAWINGS

The invention is illustrated, merely by way of example, in the accompanying drawings in which.

DESCRIPTION OF PREFERRED EMBODIMENTS

Figure 1:
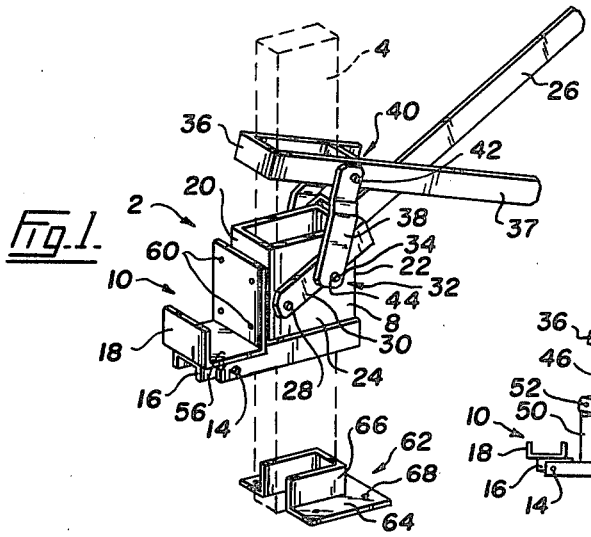
FIG. 1 is a perspective view of a lifter according to the invention.

FIG. 1 illustrates a wall lifter generally indicated at 2 able to be made to climb a column 4 (shown in broken lines) to lift a prefabricated wall 6 (see FIG. 2) into a predetermined position. The lifter 2 comprises a first sleeve 8 to surround the column 4. A saddle 10 engages a top member 12 of the wall 6. The saddle 10 extends forwardly of the first sleeve 8 and is pivotably mounted by a pivot pin 14 that engages in aligned holes in a bottom bracket 16 and an inverted C channel 18 welded to the base of the saddle 10.

Figure 2:
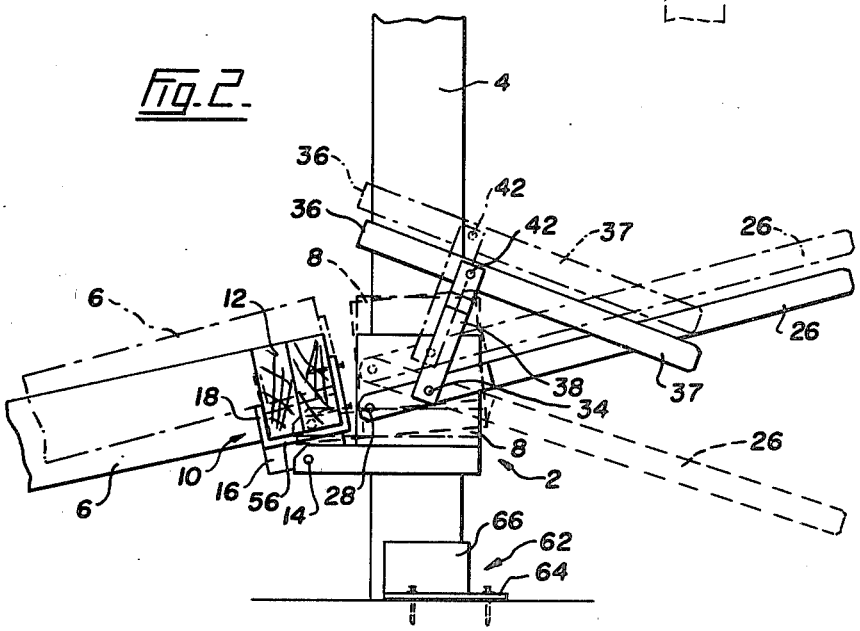
FIG. 2 illustrates the operation of the lifter of FIG. 1.
Figure 3:
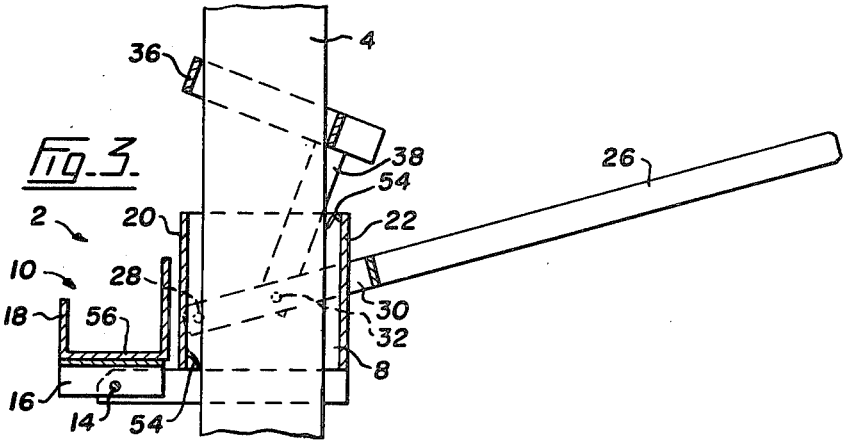
FIG. 3 is a section through the embodiment of FIG. 1.

In the embodiment of FIGS. 1 to 3 the first sleeve 8 is of substantial height and has a front wall 20 adjacent the saddle 10, a back wall 22 (FIG. 3) and side walls 24. A first lever 26 is pivotably mounted on the first sleeve 8 at a first position adjacent the saddle 8. Mounting is by a pivot pin 28 extending through aligned holes in the first lever 26 and in the side walls 24 of the first sleeve 8. In the embodiment of FIGS. 1 to 3 the first lever 26 comprises a U bracket that extends around the first sleeve 8. Pivotable connections 10 are at each end of each limb 30 of the U, adjacent the saddle 10.

A fulcrum point for the first lever (which is a primary lever) is provided by pivotable joints 32 at about the centers of each side of the limbs 30 of the U. The pivotable joints 32 are formed by holes in the ends of each limb 30 of the U, adjacent the saddle 10. The holes receive pivot pins 34.

A second sleeve 36 surrounds the column 4 and is disposed above the first sleeve 8 when the lifter 2 is in its useful position as shown in the drawings. A second lever 37 extends from the second sleeve 36 to permit tilting of the second sleeve 36 on the column 4. As indicated in the drawings the second lever 37 may simply be an extension of one side of the second sleeve 36. There is a link 38 between the first sleeve 8 and the second sleeve 36 pivotably connected to each sleeve. The connection to the second sleeve 36 is at 40 and is simply provided by aligned holes receiving a pivot pin 42. For the first sleeve 8 the pivotable connection is the pin 34 pivotably connected to each limb 30 of the U and extending through a clear hole 44 in the link 38.

Figure 4:
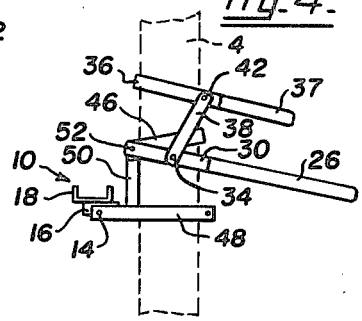
FIG. 4 illustrates a further embodiment of the invention.

In the embodiment shown in FIG. 4, where similar members are used for parts already shown in FIGS. 1 to 3, the first sleeve 8 is formed of spaced upper and lower brackets 46 and 48 that surround the column 4. There is a connecting member 50 that abuts the front of the column 4 and is pivotably attached to the upper bracket 46 and rigidly attached to the lower bracket 48. It will be appreciated that the combination of spaced upper and lower brackets shown in FIG. 4 is a mechanical equivalent of the solid sleeve 8 as shown in FIGS. 1 to 3. The pivot point for the first lever 26 is provided at the upper end of the connecting member 50 at 52.

FIG. 3 illustrates that the wall lifter 2 is provided with engagement means in the form of blades 54 adjacent an upper edge of the back wall 22 and a lower edge of the front wall 20 of the first sleeve 8 when the lifter 2 is in its useful position on a column 4 as in FIG. 4. The blades 54 extend downwardly in this position to dig into the wooden column 4. One blade 54 may be suitable but generally two preferred, especially if the column 4 is wet.

As illustrated particularly in FIG. 3 the saddle 10 is a U-shaped bracket having a base 56 and side walls 8 to abut the top member 12 of the wall 6 to be lifted. Holes 60 (FIG. 1) are formed in the rear side wall so that nails can be driven into the top member 12 of the wall 6 to secure the wall 6 in position during lifting. If, as shown in FIG. 2, the top member 12 of the wall 6 is not composed of wood sufficiently thick to occupy all the available space within the saddle 10 then it is desirable that the saddle 10 be filled by inserting timber of the appropriate thickness.

As shown particularly in FIGS. 1 and 2 it is desirable that the lifter be associated with a non-slip shoe 62 that contacts the base of the column 4 to prevent its slipping during lifting of the wall 6. The non-slip shoe 62 has a base 64 and upwardly extending side walls 66. The base 64 is provided with holes 68 (see FIG. 1) that can be nailed to the floor of the building where the wall is being constructed (see FIG. 2).

The use of the bracket is illustrated particularly in FIG. 2. When it is desired to lift the prefabricated wall 6 into a predetermined position in a building the saddle 10 is placed beneath the top member 12 of the wall 6. The top member 12 is nailed in position in the saddle 10 by nails through the holes 60. The column 4 is inserted in the aligned first and second sleeves 8 and 36. Hand pressure is applied downwardly to the second lever 36 and the first lever 8 is then moved downwardly to raise the first sleeve 8 with its attached saddle 10 and, of course, the wall 6 to about one foot. When the first sleeve 8 is raised, pressure is released on the first lever 26 and the weight of the wall 6 acting downwardly tends to dig the first sleeve 8 at the lower edge of the front wall 20 and the upper edge of the back wall 22 into the column 4 thus locating it temporarily. The pressure is released on the second sleeve 36 by releasing the second lever 37 and moving it up the column 4 by sliding it. The lifting action is then repeated first by by pressing down on the second lever 37 to cause the second sleeve 36 to tilt and thus grip the column 4, and then pressing down on the first lever 26 which, of course, is raised to the upper position—that is the position shown in FIG. 1 and in solid outline in FIG. 2—by the upward movement of the second sleeve 36 by virtue of the pivotable connections between the first sleeve 8 and the second sleeve 36. The column 4 inclines as the wall is lifted, the inclination, of course, being towards the wall 6.

The illustrated embodiments act in the same way. FIG. 3 shows that contact of the first sleeve 8 with the column 4 is made more positive by the provision of blades 54.

The lifter may be made of mild steel plate.

I claim:

1. A wall lifter able to be made to climb a column to lift a prefabricated wall into a predetermined position, the lifter comprising:

a first sleeve to surround the column;

a saddle to engage the wall, the saddle extending forwardly of the first sleeve and being pivotably mounted;

a first lever pivotably mounted on the first sleeve at a first position adjacent the saddle and able to raise and tilt said first sleeve;

a fulcrum point for the first lever;

a second sleeve to surround the column disposed above the first sleeve when the lifter is in its useful position;

a second lever extending from the second sleeve to permit tilting of the second sleeve on the column, and a link between the first and second sleeves, pivotably connected to each sleeve.

2. A wall lifter as claimed in claim 1 in which the first sleeve is formed of spaced upper and lower brackets that can surround the column and a connecting member, to abut the front of the column, attached to the upper and lower brackets.

3. A wall lifter as claimed in claim 1 in which the first sleeve is of substantial height having a front wall adjacent the saddle, a back wall and side walls, the side walls providing the mounting position for the first lever.

4. A wall lifter as claimed in claim 3 in which the lifter is provided with two engagement means to dig into the column, a first engagement means adjacent the lower end of the front wall of the first sleeve and a second engagement means adjacent an upper edge of the rear wall of the first sleeve, when the lifter is in its useful position.

5. A wall lifter as claimed in claim 4 in which the engagement means are blades extending downwardly when the lifter is in its useful position.

6. A wall lifter as claimed in claim 1 in which the first sleeve has sides that extend at the base of the sleeve forward of the column to define an opening;

a member pivotably mounted in the opening;

the saddle rigidly attached to the member and dimensioned to contact the sides of the base of the sleeve in a rest position.

7. A wall lifter as claimed in claim 1 in which the saddle is a U-shaped bracket having a base and side walls to abut the wall to be lifted.

8. A wall lifter as claimed in claim 7 in which at least one wall of the saddle is formed with holes to permit an edge of the wall to be nailed in the saddle during lifting.

9. A wall lifter as claimed in claim 1 in which the link extends from the second sleeve and is pivotably connected to the first lever to define said fulcrum for the lever.

10. A wall lifter as claimed in claim 1 in which the first lever comprises a U-bracket to extend around the first sleeve;

pivotable connections at each end of each limb of the U, adjacent the saddle;

pivotable joints at about the centres of each side of the U defining fulcrum points on each side of the lifter; and a handle extending outwardly from the base of the U.

11. A wall lifter as claimed in claim 1 including a non-slip shoe associated with the lifter to engage and anchor the base of the column during the lifting of the wall.

12. A wall lifter able to be made to climb a column to lift a prefabricated wall into a predetermined position, the lifter comprising a first sleeve having side walls, a front wall and a rear wall and able to surround the column, the side walls extending forwardly at at least their lower edges;

a member pivotably mounted between the extending lower edges of the side walls of the first sleeve and extending from the front wall of the sleeve;

a saddle to engage the edge of the wall rigidly connected to the member;

column engagement means projecting downwardly from the top of the rear wall of the first sleeve and from the bottom of the front wall of the first sleeve;

a primary lever extending around the walls of the first sleeve and pivotably attached to each wall adjacent the saddle and extending backwardly to a handle;

a link pivotably engaged to each side of the primary lever at a fulcrum point for the lever at a first end of each link;

a second sleeve to surround the column, above the first sleeve when the lifter is in its useful position, pivotably joined to the link at the second end of the link; and a lever extending outwardly from the second sleeve to permit tilting of the second sleeve on the column.

* * * * *